United States Patent [19]

Martin

[11] 4,303,909

[45] Dec. 1, 1981

[54] ELECTRONICALLY ALARMED LOCK

[75] Inventor: Franklin J. Martin, Carson City, Nev.

[73] Assignee: James A. Martin, Carson City, Nev.; a part interest

[21] Appl. No.: 85,922

[22] Filed: Oct. 18, 1979

[51] Int. Cl.[3] ..... E05B 45/10; G08B 13/08

[52] U.S. Cl. ..... 340/543; 340/507; 340/545; 340/636

[58] Field of Search ..... 340/543, 545, 636, 663, 340/661, 507

[56] References Cited

U.S. PATENT DOCUMENTS

| | | | |
|---|---|---|---|
| 2,011,944 | 8/1935 | Lodispoto . | |
| 2,339,170 | 1/1944 | Jacobs | 340/545 |
| 2,874,240 | 2/1959 | Ricks . | |
| 3,317,904 | 5/1967 | Clay | 340/545 |
| 3,392,558 | 7/1968 | Hedin et al. | 340/543 |
| 3,452,347 | 6/1969 | Stimson | 340/636 |
| 3,660,624 | 5/1972 | Bell . | |
| 3,663,774 | 5/1972 | Feder | 340/543 |
| 3,797,004 | 3/1974 | Muessel et al. . | |
| 3,803,575 | 4/1974 | Gotanda | 340/545 |
| 3,858,193 | 12/1974 | Bach | 340/545 |
| 3,986,376 | 10/1976 | Lack . | |
| 4,061,004 | 12/1977 | Pappanikolaou . | |
| 4,194,176 | 3/1980 | Fukuma | 340/543 |

*Primary Examiner*—Glen R. Swann, III

*Attorney, Agent, or Firm*—Harvey B. Jacobson

[57] ABSTRACT

A standard mechanical lock is provided with an electrical coding system for setting off an alarm in the event that an incorrect key is used or the lock is tampered with. The electrical coding system includes a binary code inscribed in the back edge of the key. A plurality of conductive fingers are mounted on the lock body to contact the back of the key when the key is rotated in the lock. A decoding circuit is provided which sounds an alarm in the event that an incorrect code is presented to the fingers. In the event that an attempt is made to pick the lock, one or more of the fingers will become grounded thus setting off the alarm. Automotive and building applications are disclosed wherein microswitch sensors are placed at strategic locations to set off the alarm in the event that an attempt is made to circumvent the mechanical lock.

11 Claims, 11 Drawing Figures

Fig.7
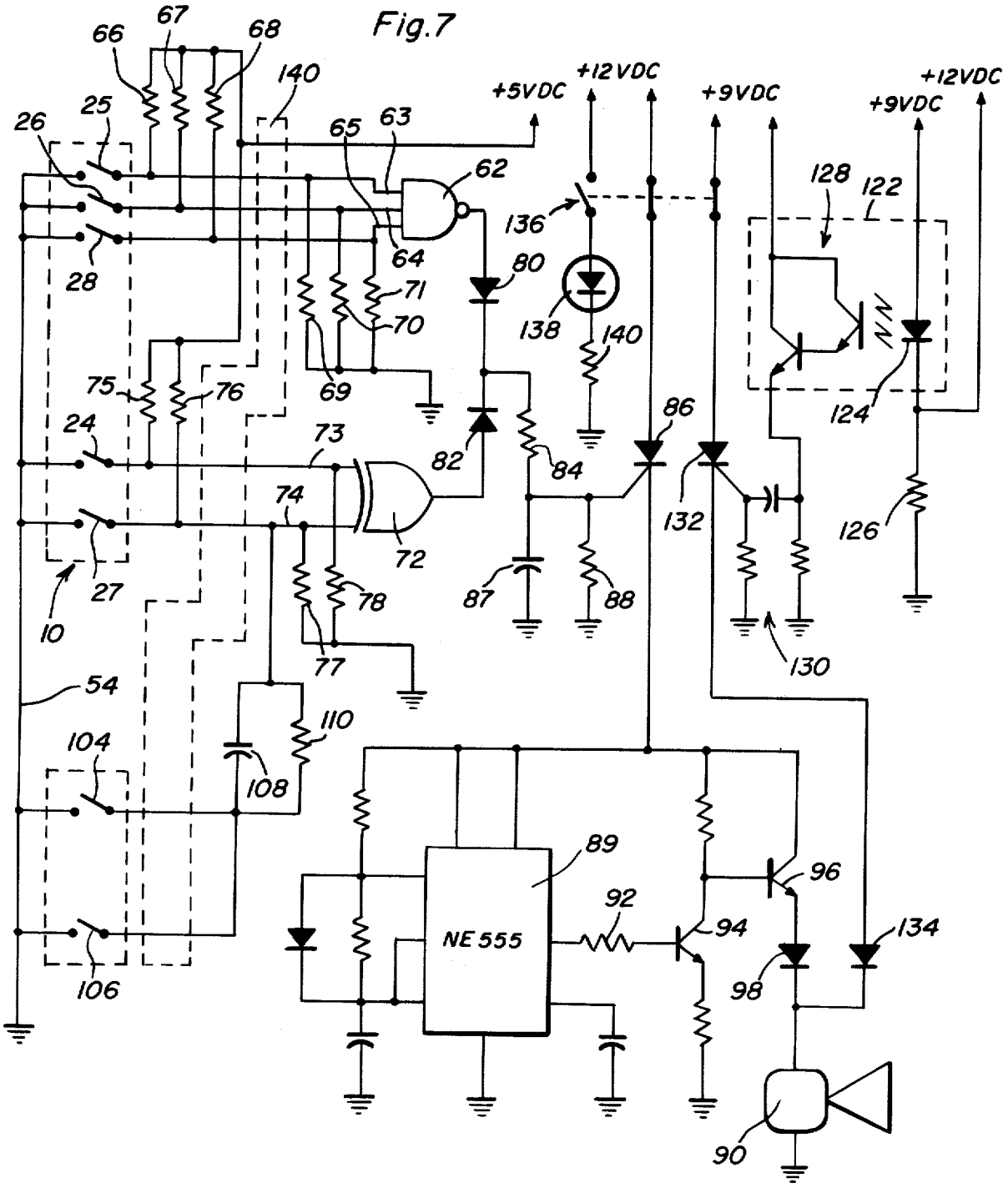
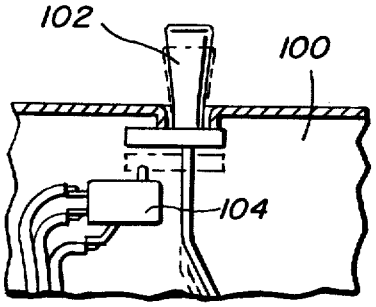
Fig. 8

ELECTRONICALLY ALARMED LOCK

BACKGROUND OF THE INVENTION

1. Field of the Invention

This invention relates to locking arrangements in general and in particular to an alarm system incorporated in a lock structure for producing an alarm signal upon an attempt to open the lock structure through other than use of a designated key.

2. Discussion of Related Art

Many pick-proof and alarmed locks have been suggested in the past. For instance, U.S. Pat. No. 2,011,944, issued Aug. 20, 1935, to Lodispoto, shows a combined lock and switch for an alarm wherein a lock body has a key slot formed wider than the key. Grooves are formed in the sides of the key slot and coact with transverse ribs which extend for the length of the key. Pins extend into the key slot and if a false key is inserted into the slot it will contact one of the pins. The proper key will be guided by the transverse ribs and avoid the pins.

U.S. Pat. No. 2,874,240, issued Feb. 17, 1959, to Ricks, shows an automatic door-opening signal device wherein a sleeve is placed over a door knob. The sleeve has a cam surface which contacts a switch upon rotation of the door knob and the sleeve. The switch in turn actuates an alarm when an attempt is made to open the door.

U.S. Pat. No. 3,660,624, issued May 2, 1972, to Bell, shows an electrical key for ignition systems. The Bell device includes a key having adapters that are irremovably interposed between a predetermined number of spark plug cable receptacles and their respective distributor contacts. The electrical key includes an electrical coded key element which works in conjunction with an electrical coded key adapter when the key element is inserted to produce an electrical continuity in the vehicular ignition system.

U.S. Pat. No. 3,797,004, issued Mar. 12, 1974, to Muessel et al., shows a lock tumbler cylinder picking alarm. A shutter is mounted on a front portion of a key plug that rotates in a lock tumbler cylinder, and an electric switch on the cylinder has a spring contact arm pressing the shutter to a position closing the entrance opening of the keyway. A key or other instrument inserted toward the keyway must move the shutter so that the spring arm will complete an electric circuit causing an alarm signal before the instrument can engage any one of the lock tumblers. The shutter will move away from the spring arm when the key plug rotates so that the alarm signal will be brief when a proper key is used, and a short time delay in the alarm circuit then will withhold operation of an alarm.

U.S. Pat. No. 3,986,376, issued Oct. 19, 1976, to Lack, shows a pin and tumbler type lock in which a slide element is disposed at the end of the cylinder opposite the end from which the key is inserted. The slide element cooperates with a pin in the barrel and has a projecting portion diametrically opposite to the pin with which it cooperates which, in the locked condition, engages in an opening of the barrel. The slide element has a configuration for cooperation with the leading end of a key so that insertion of the correct key causes disengagement of that portion of the slide extending into the opening in the barrel and additionally brings abutting portions of the slide element and the cooperating pin to a shear line between the cylinder and the barrel to free the lock.

U.S. Pat. No. 4,061,004, issued Dec. 6, 1977, to Pappanikolaou, shows a pick-proof lock cylinder having a keyhole which opens to provide access to the cylinder. Two cam surfaces are provided on the remote end of the keyhole configuration to deflect a pair of coded, pivotally mounted fingers on a jointed key which is receivable within the keyhole. The fingers of the key may be mechanically or magnetically coded to cause the enabling pins or plungers to be actuated when the key is fully inserted into the keyhole, and the coded fingers are deflected to their operative positions by the cam surfaces.

SUMMARY OF THE INVENTION

One object of the present invention is to provide an electronically alarmed lock which employs standard mechanical lock components and is capable of producing an alarm signal when an attempt is made to actuate the lock by the use of an incorrect key.

Another object of the present invention is to provide an electronically alarmed lock which produces an alarm signal upon an attempt to pick the mechanical lock.

Yet another object of the present invention is to provide an electronically alarmed lock which produces an alarm signal when an attempt is made to open a locked door by circumventing the lock structure altogether as by removing the door from its hinges.

Still another object of the present invention is to provide an electronically alarmed lock which is relatively simple in construction, yet fool-proof in operation.

In accordance with the above objects, the electronically alarmed lock of the present invention incorporates the principles of a standard mechanical lock, such as a pin tumbler lock, adding features of an electrical coding system. The rear of the key shank is notched in a binary coded fashion. A plurality of resilient fingers extend radially through the side of the lock into the tumbler to contact the coded rear of the key shank. When the key is inserted and turned, the rear of the shank comes into contact with the fingers and an incorrectly coded key will produce an incorrect output from the fingers thus producing an alarm. A decoding circuit is connected to the fingers and comprises standard logic gates. A high output from the decoding circuit initiates operation of a thyristor which sends current to an alarm device. The electronically alarmed lock can be used as, for example, an automobile door lock or a building door lock. In addition to the inputs from the coded mechanical lock, the decoding circuit receives inputs from sensors in the form of microswitches positioned about the door. If an attempt is made to bypass the lock, such as by directly pushing a door bolt back, one of the strategically positioned microswitches sends a signal to the decoding circuit and the alarm is set off. Once the mechanical lock is properly opened by use of the appropriate key, the microswitch sensor inputs are no longer effective. Other features of the invention include a low voltage sensor for the battery power supply and an appropriate circuitry to insure an alarm activation if an attempt is made to disconnect or sever the wires between the mechanical lock and the alarm circuit board.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7 is a schematic diagram showing the decoding and alarm circuitry of the present invention.

FIG. 8 is an illustration showing the positioning of a microswitch sensor of the present invention in an automobile door.

DESCRIPTION OF THE PREFERRED EMBODIMENTS

Figure 1:
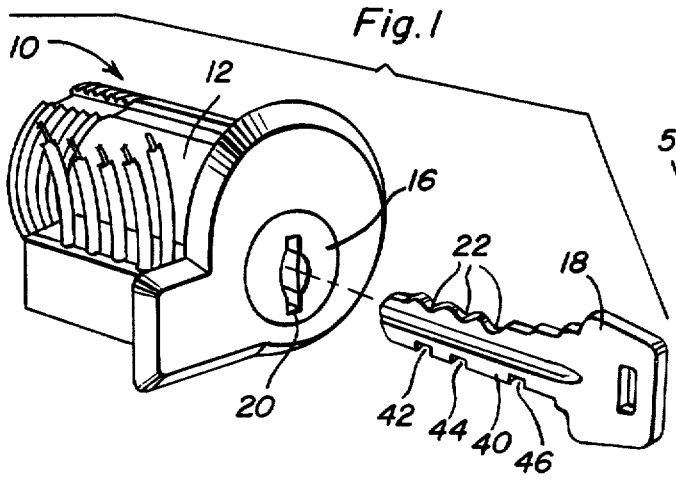
FIG. 1 is a perspective view of an electronically alarmed lock forming the present invention.

Now with reference to the drawings, an electronically alarmed lock incorporating the principles and the concepts of the present invention will be described in detail. With particular reference to FIGS. 1 through 6, the operation of the mechanical components of the invention will be set forth. It should be noted that any key operated lock can be equipped with an alarm system as disclosed herein. For purposes of explanation, a pin tumbler mechanical lock 10 will be used. Pin tumbler lock 10 is of a standard design having housing 12 which slidably mounts a plurality of segmented pins 14 biased radially inwardly of the housing. A barrel 16 is rotatably mounted in housing 12. The barrel 16 is biased against rotation by pins 14 which extend radially into the barrel. A key 18 fits into a key slot 20. The key 18 has a shank portion containing a front edge having a plurality of stepped portions 22 which engage with and move the pins 14 so that the division 19 in each pin aligns with the outer periphery of the barrel 16 in a well-known manner to enable the barrel to be rotated.

Figure 6:
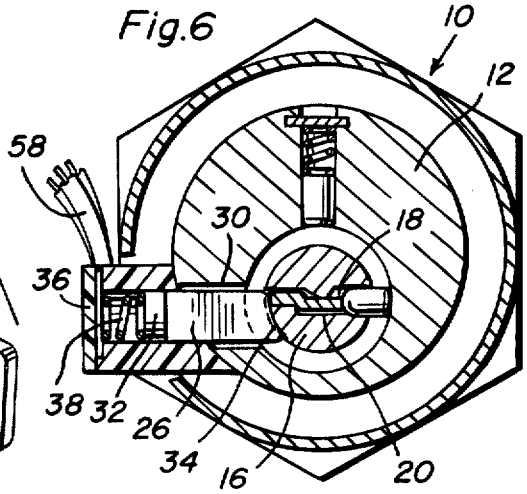
FIG. 6 is a front elevational sectional view taken substantially along a plane passing through section line 6—6 of FIG. 5.
Figure 2:
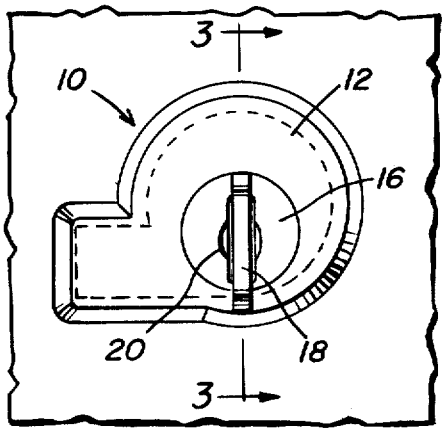
FIG. 2 is a front elevational view of the electronically alarmed lock showing a key as initially inserted into the lock.
Figure 3:
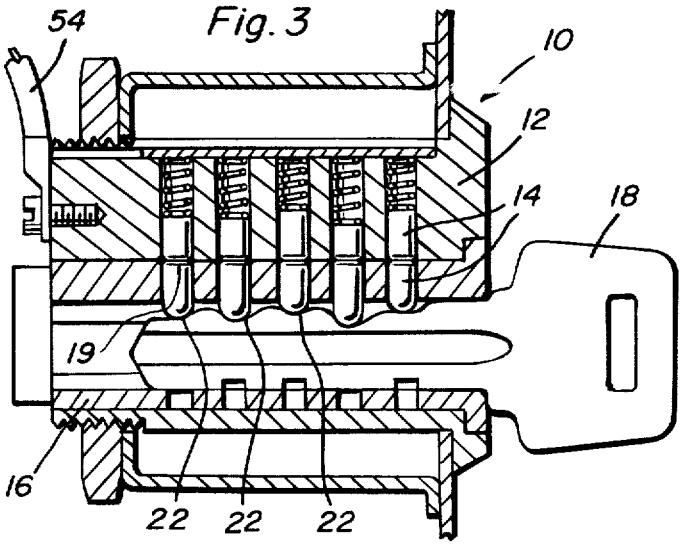
FIG. 3 is a side elevational view taken substantially along a plane passing through section line 3—3 of FIG. 2.
Figure 4:
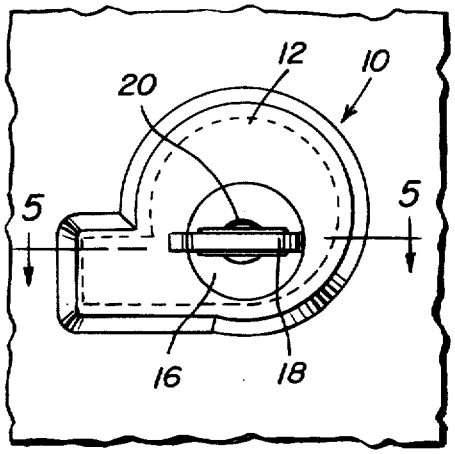
FIG. 4 is a front elevational view of the lock showing the key as initially turned to contact the sensing fingers.
Figure 5:
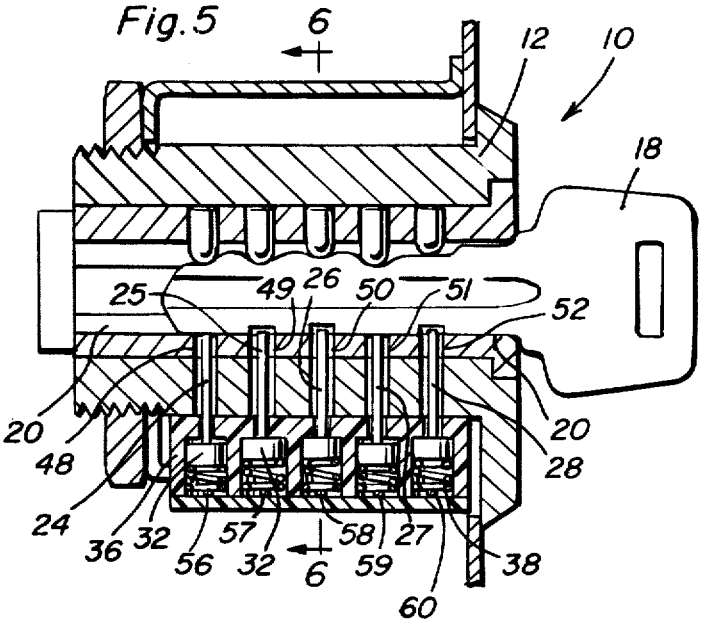
FIG. 5 is a top plan sectional view taken substantially along a plane passing through section line 5—5 of FIG. 4.

The alarm system built into the mechanical lock includes a plurality of electrically conductive fingers 24 through 28. As shown in FIG. 6, each finger includes a blade portion 30 attached to a head 32. Each blade 30 is approximately 0.03 inches in thickness and 0.125 inches wide. Each blade terminates in an arcuately shaped contacting tip 34, which tip is approximately coaxially aligned with the barrel 16. Fingers 24 through 28 extend outwardly of the housing 12 with heads 32 being enclosed in a plastic casing 36. Each head is enclosed in a separate chamber in the casing 36 and is biased toward the housing 12 by means of compression springs 38. Each finger is produced from an electrically conductive material, such as copper, or the like, and should, preferably, be covered with an insulative coating in order to insure that no electrical contact will be made between the individual fingers and the housing 12.

Each finger 24 through 28 is associated with a separate section along the back 40 of the shank of key 18. Shank back 40 is notched at appropriate places as shown at 42, 44 and 46 to provide a binary code. A plurality of circumferential grooves are formed in the barrel 16 with one groove being associated with each of the fingers 24 through 28, the grooves being designated by the reference numerals 48 through 52, respectively. Each groove communicates with the key slot 20 in the area of the key back 40 in order that the individual fingers are capable of making contact with the key shank back 40. The tip 34 of each finger is biased into its respective groove and extends through into the key slot 20. When the key is rotated with the barrel 16, those portions of the key shank back 40 which are notched as shown at 42, 44 and 46 are spaced from their associated fingers 25, 26 and 28 and no electrical contact is made. Those portions of the key shank back 40 which are not notched will come into electrical contact with their associated fingers. A ground wire 54 (FIG. 3) is connected to the housing 12 while a separate lead 56 through 60 (FIG. 5) is in contact with each of the respective fingers 24–28 through their associated springs 38.

It will be noted that casing 36 and fingers 24 through 28 extend into the housing 12 at a position spaced circumferentially of the initial position of the key slot 20 in barrel 16. Accordingly, the key 18 can easily be inserted into the key slot 20 without fear of contacting any of the fingers. Only upon rotation of the barrel the appropriate sections of the key shank back 40 contact the selected fingers 24–28. These contacts will be made at approximately the same time. Contact with the fingers 24–28 is maintained for as long as desired by appropriately dimensioning the width of each finger and the length of each tip 34. In this manner, a proper contact with the key shank back 40 will be insured.

Now with reference to FIG. 7, a typical decoding and alarm actuation circuit to be used will be described. It will be seen that a NAND gate 62 has inputs 63, 64 and 65 which are connected respectively to conductive fingers 25, 26 and 28. Inputs 63 through 65 are connected through biasing resistors 66, 67 and 68, respectively, to a 5 volt DC power source. The inputs are also connected to ground return resistors 69, 70 and 71, respectively. In a similar manner, an exclusive OR gate 72 has inputs 73 and 74 which are connected respectively to fingers 24 and 27. Inputs 73 and 74 are further connected to biasing resistors 75 and 76, respectively, and also to ground return resistors 77 and 78. The outputs of gates 62 and 72 are passed through diodes 80 and 82, respectively. The cathodes of diodes 80 and 82 are connected through current limiting resistor 84 to the gate of SCR 86. A time delay network comprising capacitor 87 and resistor 88 is connected between the gate of SCR 86 and the ground. The anode is SCR 86 is connected to a 12 volt DC power supply. The cathode of SCR 86 is connected to an alarm actuation circuit comprising integrated circuit timer 89. The output of timer 89 causes pulsed actuation of audible alarm 90 through resistor 92, output transistors 94 and 96 and diode 98.

In operation, when the correct coded key is inserted in the mechanical lock, fingers 24 and 27 are grounded while fingers 25, 26 and 28 remain in an open circuit condition. Thus the outputs of gates 62 and 72 remain in the low state and SCR 86 remains off. If an incorrect key is inserted into the lock and turned, gate 62 and/or gate 72 will provide a high output which turns on SCR 86 and causes pulsed operation of audible alarm 90 through the timer 89 and its associated timing circuitry. Naturally if an attempt is made to pick the lock 10, in all probability, one or more of the fingers 24 through 28 will be grounded thus setting off the alarm. Likewise, if an attempt is made to drill out the lock or distort the lock in any way, one or more of the fingers will contact the lock housing and set off the alarm 90.

The electronically alarmed lock can be used in virtually any situation wherein a key rotated locking mechanism is employed. For purposes of illustration, typical alarm systems as utilized in the door of a building structure and the door of an automobile will now be described. In either application, additional microswitch sensors are incorporated in the system to provide an input in the event that an attempt is made to open the locked door by circumventing the mechanical lock itself. With reference to FIG. 8, it will be seen that automotive door 100, having a standard locking mechanism 102, is supplied with a microswitch sensor 104 which is normally open when the locking mechanism 102 is depressed into the locked position. Another microswitch sensor shown at 106 in FIG. 7 is employed to sense the opening of the door. Switch 106 can be used in place of the normal interior light door actuated switch available on the door post of any modern automobile. Switch 106 would be in the normally open position with the door closed. Thus, with reference to FIG. 7, it can be seen that if the door is unlocked or opened without first actuating the mechanical door lock with key 18 so as to ground fingers 24, 27, one or both of the microswitches 104 and 106 would be closed thus grounding input 74 of exclusive OR gate 72 causing the output of that gate to go high resulting in a pulsed actuation of alarm 90. Switches 104 and 106 are connected to input 74 through a differentiating network comprising capacitor 108 and the resistor 110 in order that only a short duration pulse is received at input 74. In this manner, when the door is unlocked by use of a key, capacitor 108 will charge up during the unlocking procedure and the alarm will not be set off after key 18 is removed from the mechanical lock.

Figure 10:
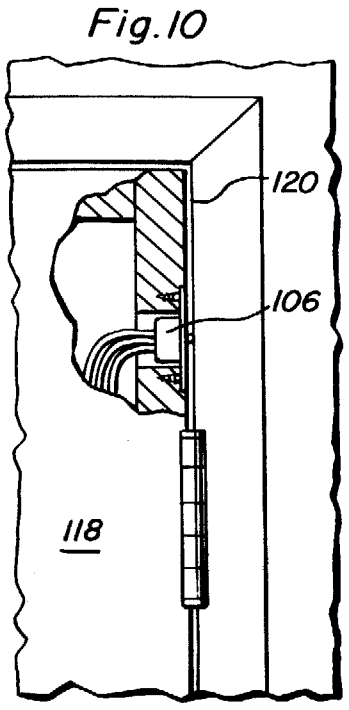
FIG. 10 is a diagram showing placement of a microswitch sensor in a building door adjacent the door jamb.
Figure 11:
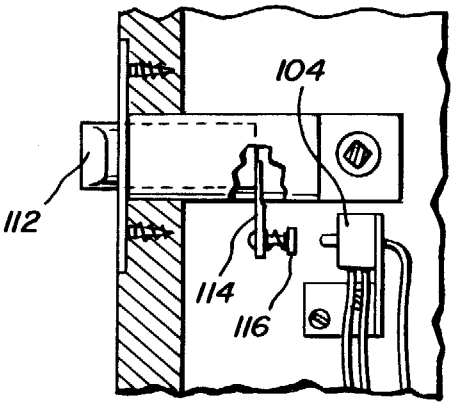
FIG. 11 is a diagram showing the placement of a microswitch sensor in a building door actuated by a door bolt.
Figure 9:
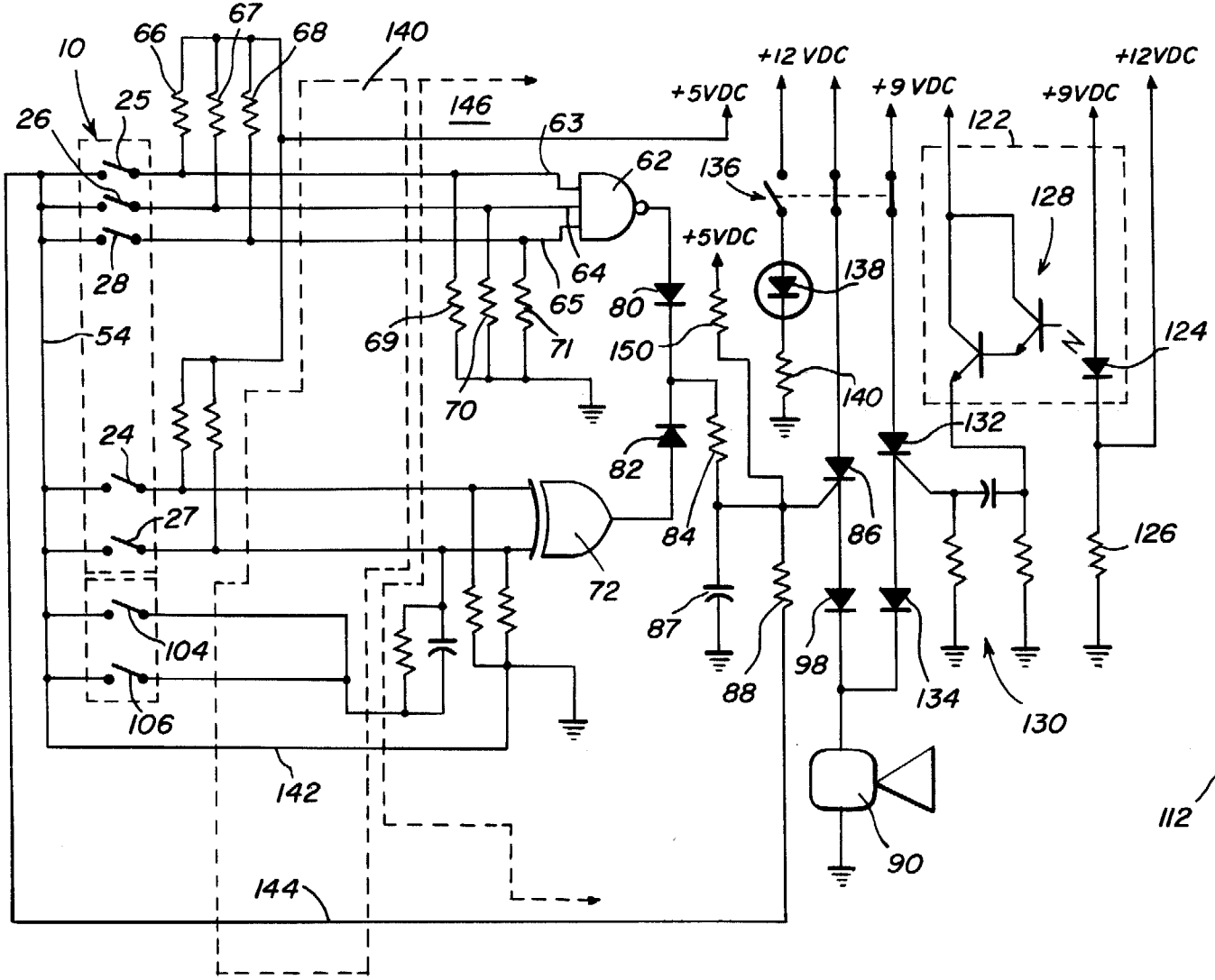
FIG. 9 is a schematic diagram of a second embodiment of the decoding and alarm circuitry of the present invention.

FIGS. 9 and 10 show the positioning of microswitches 104 and 106 when used in the door of a building structure. Microswitch 104 is positioned inside the door proximate the door bolt 112. An actuation flange 114 is mounted on the bolt for movement therewith. A spring loaded switch actuator 116 extends rearwardly from flange 114 to make contact with switch 104. Switch 104 is normally opened and closes only upon contact with actuator 116. Thus, if one tries to circumvent the mechanical lock by inserting an element between the door and the jamb to push bolt 112 backwards, switch 104 will cause a low signal to be transferred through the differentiating network 108, 110 to input 74 of exclusive OR gate 72 and alarm 90 will be sounded. Microswitch 106 is mounted inside the door 118 and is actuated upon contact with the door jamb 120. Thus, if an attempt is made to open a door by means such as removing the door from its hinges, switch 106 will be actuated thus sounding alarm 90 through exclusive OR gate 72.

Referring again to FIG. 7, it will be seen that the circuit for the alarm also includes a battery low voltage detector 122. Detector 122 comprises an LED 124 which has its anode connected to an auxiliary nine volt battery and its cathode connected to the main 12 volt supply. Also, a current limiting resistor 126 is connected between the LED anode and the ground. Thus, if the 12 volt supply fails for any reason or is reduced sufficiently below nine volts, LED 124 will be actuated thus causing excitation of the phototransistor pair 128. Phototransistor 128 is connected through a differentiating network 130 to the gate of SCR 132. SCR 132 drives the alarm 90 through a diode 134 in a continuous manner from the nine volt auxiliary battery. Also, included in the circuit of FIG. 7 is an on/off switch 136 which has three sets of ganged contacts for removing power from SCR 86 and SCR 132 to completely disable the alarm 90. When in the off position, switch 136 connects an LED 138 to ground through resistor 140 to provide a visual indication of the disabling of the alarm system.

Again, with reference to FIG. 7, it will be noted that the lock body, denoted by reference numeral 10, is connected to the alarm actuation circuit by a cable 140. This cable would extend, for example, from the lock position on door 118 to the location of the circuit board containing the elements for actuating alarm 90. Leads extending from switches 104 and 106 are also included in this cable. In order to insure that the alarm system cannot be disabled by cutting the cable, biasing resistors 66, 67, 68, 75 and 76 are located physically connected to the lock body so that cutting the cable will remove positive bias from the inputs to gates 62 and 72. For this reason, the ground return resistors 69 through 71, 77 and 78 are connected to the input leads of these gates in physical proximity to the gates and thus cause these leads to be grounded when cable 140 is cut. Accordingly, cutting of the cable will cause the output of NAND gate 62 to go high, thus causing actuation of alarm 90.

FIG. 9 shows a second embodiment of the decoding and alarm circuitry of the present invention wherein the alarm 90 is activated directly by the removal of integrated circuit timer 89 and its associated circuitry. The schematic of FIG. 9 also demonstrates the advantages of using a pair of grounding wires 142 and 144 connected between the circuit board 146 and the mechanical lock 10. Obviously, if the system is to be used in a building structure, the use of grounding wire 142 would be necessary where no common metallic framework exists to act as a ground. In an automotive application, ground wire 142 would be unnecessary. Grounding wire 144 extends from resistor 88 to grounding wire 54 which is attached to the mechanical lock 10. By routing the ground connection of resistor 88 through the lock 10, it is possible to include a connection to the 5 volt DC supply through bias resistor 150 to the gate of SCR 86. Accordingly, if an attempt is made to cut cable 140, resistor 88 is no longer grounded and the gate of SCR 86 is raised to the five volt turn on potential thus actuating alarm 90. Accordingly, one more tamper-proof feature can be added to the circuit by merely including a ground wire 144.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An electronically alarmed lock comprising:

a mechanical lock structure including a lock body, cylinder means rotatably mounted within said lock body, said cylinder means having a key slot formed therein;

a key having a shank adapted to fit into said key slot, said shank having defined thereon a plurality of coded sections;

sensor means mounted on said lock body and including a plurality of code sensing elements with one of said code sensing elements being operatively associated with each one of said coded sections;

decoding circuit means operatively connected to said sensor means for decoding said coded sections, said decoding circuit means including a plurality of logic gates, each of said logic gates having an input connected from said sensor means;

biasing means connected to said logic gate inputs for maintaining said inputs at a high voltage level, said biasing means being located physically near said lock body, said logic gates being located physically remote from said lock body;

a cable extending between and connecting said biasing means and said logic gates; and alarm means operatively connected to said decoding circuit means for producing an alarm in response to all but certain predetermined decoded signals.

2. The lock defined in claim 1 wherein each of said code sensing elements comprises a conductive probe extending into said lock body, said plurality of coded sections comprising areas along a back portion of said shank.

3. The lock defined in claim 2 wherein said coded sections contain a binary code defined by notches formed in selected ones of said coded sections.

4. The lock defined in claim 2 wherein said cylinder means has a cylindrical outer surface; a plurality of circumferential grooves formed in said outer surface, one of said conductive probes extending into each one of said grooves, each of said grooves directly communicating with said key slot at at least one point along the extent of the groove.

5. The lock defined in claim 1 wherein said cylinder means rotates from an initial position, said sensor means being disposed on said lock body at a position spaced circumferentially of said cylinder means from a position in lateral alignment with said key slot when said cylinder means is in its initial position.

6. The lock defined in claim 1 and further including grounding resistors, at least one grounding resistor being connected between selected ones of said inputs and electrical ground for communicating said selected inputs to ground upon said cable's being cut.

7. The lock defined in claim 1 wherein said alarm means includes thyristor means having a gate connected to said logic gates; biasing means connected to said gate, said biasing means comprising a voltage source and a resistor connected between said voltage source and said gate; grounding means connected to said gate, said grounding means comprising a resistor connected between said gate and electrical ground, said resistor being connected to electrical ground through a wire extending through said cable for removing said ground connection upon the cable being cut.

8. The lock defined in claim 1 and further including low voltage signalling means, said low voltage signalling means comprising a light emitting diode having its anode connected to a reference voltage source and its cathode connected to a voltage source supplying current to said decoding circuit means.

9. The lock defined in claim 1 and further wherein said lock is disposed in combination with a door; first sensor switch means connected to said door and operative to provide a signal to said one of said logic gate inputs upon the opening of said door.

10. The combination defined in claim 9 wherein said door is the door of an automobile having a depressible locking latch; second sensor switch means disposed in operative communication with said depressible locking latch, said second sensor switch means being connected to one of said logic gate inputs for providing an input upon actuation of said depressible lock latch.

11. The combination of claim 9 wherein said door is disposed in a building structure, said door including a displaceable bolt means for holding said door in a closed position; second sensor switch means disposed in operative relation to said bolt, said second sensor switch means being connected to one of said logic gate inputs for providing an input upon displacement of said bolt.

* * * * *